US007901019B2

(12) United States Patent
Laundroche et al.

(10) Patent No.: US 7,901,019 B2
(45) Date of Patent: Mar. 8, 2011

(54) DOOR ASSEMBLY FOR USE IN A HOME APPLIANCE

(75) Inventors: Kevin Laundroche, Anchorage, KY (US); Mahendra Madhukar Patil, Karnataka (IN)

(73) Assignee: General Electric Company, Schenectady, NY (US)

( * ) Notice: Subject to any disclaimer, the term of this patent is extended or adjusted under 35 U.S.C. 154(b) by 461 days.

(21) Appl. No.: 12/006,078

(22) Filed: Dec. 28, 2007

(65) Prior Publication Data

US 2009/0165258 A1 Jul. 2, 2009

(51) Int. Cl.
*A47B 96/04* (2006.01)

(52) U.S. Cl. ..... 312/405; 312/325; 312/326

(58) Field of Classification Search ..... 312/405, 312/138.1, 139, 325–329; 62/449; 16/412; 49/260, 252, 250, 246–248
See application file for complete search history.

(56) References Cited

U.S. PATENT DOCUMENTS

| | | | | | |
|---|---|---|---|---|---|
| 3,403,473 | A * | 10/1968 | Navarro | 49/193 |
| 3,889,419 | A * | 6/1975 | Maleck | 49/193 |
| 5,222,792 | A * | 6/1993 | Kai et al. | 312/406 |
| 5,369,912 | A * | 12/1994 | Ginzel et al. | 49/141 |
| 5,412,839 | A | 5/1995 | McCollom | |
| 5,908,228 | A * | 6/1999 | Lee | 312/405 |
| 5,910,077 | A * | 6/1999 | Aumiller et al. | 49/460 |
| 5,983,453 | A * | 11/1999 | Miwa | 16/231 |
| 6,000,771 | A * | 12/1999 | Wissinger et al. | 312/405 |
| 6,364,376 | B1 | 4/2002 | Spargo | |
| 6,375,291 | B1 * | 4/2002 | Nam et al. | 312/405 |
| 7,556,324 | B2 * | 7/2009 | Benz | 312/405 |
| 2003/0071549 | A1 * | 4/2003 | Tarantik | 312/405 |
| 2005/0200253 | A1 * | 9/2005 | Wissinger et al. | 312/405 |
| 2005/0285491 | A1 | 12/2005 | Lee | |
| 2006/0043852 | A1 * | 3/2006 | Kwon | 312/405 |

* cited by examiner

*Primary Examiner* — Hanh V Tran
(74) *Attorney, Agent, or Firm* — Fay Sharpe LLP

(57) ABSTRACT

An appliance and door assembly having a body; a member extending from the body; at least one door mounted to the member; an articulated handle mounted to the door; and a first linkage member connecting the handle to the member. The articulated handle and door includes a door, a handle mounted to the door via a hinge, and a linkage member mounted to the handle via a hinge.

22 Claims, 14 Drawing Sheets

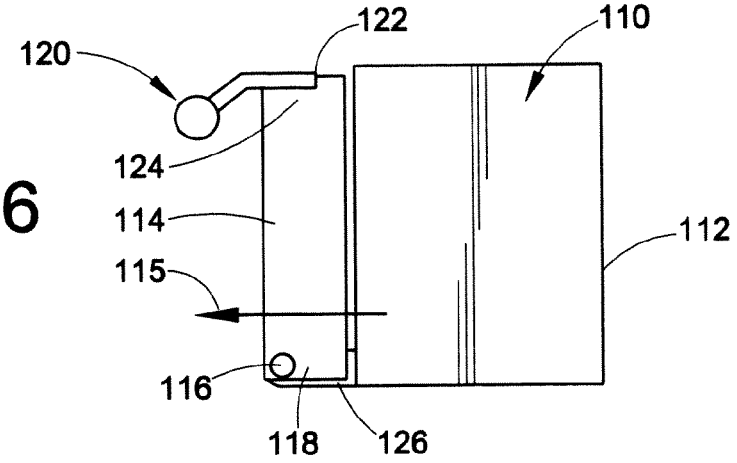
FIG. 16
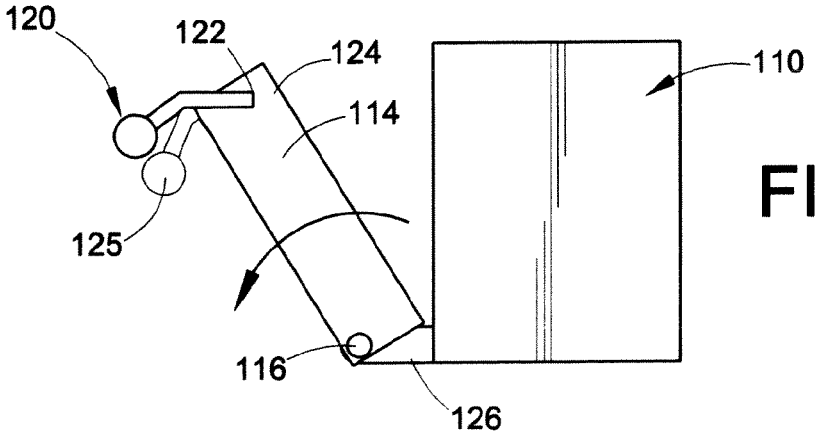
FIG. 17
FIG. 18
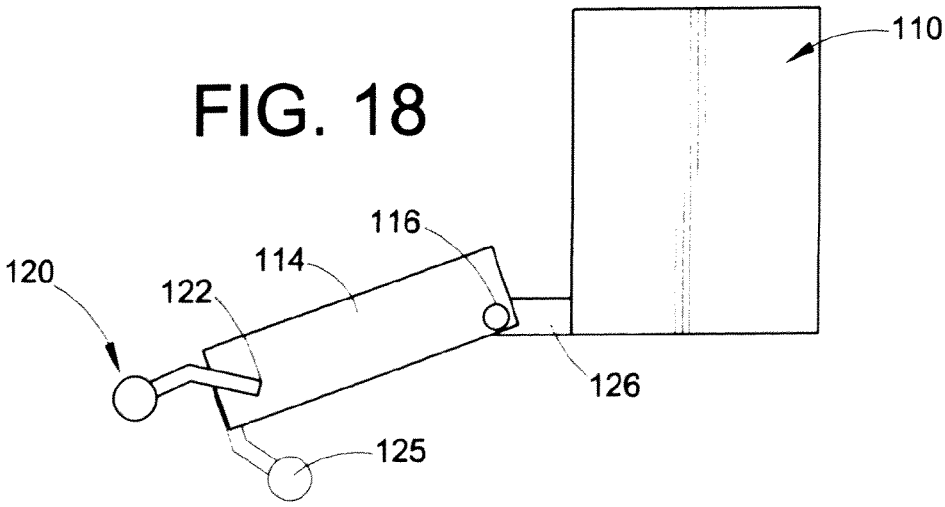

DOOR ASSEMBLY FOR USE IN A HOME APPLIANCE

BACKGROUND OF THE INVENTION

The present disclosure relates to a door assembly comprised of a door provided in a cabinet of a home appliance and a door handle for operating the door, and more particularly, to a door assembly in which a door handle is articulated to facilitate opening and closing the door.

A home appliance generally comprises a plurality of outer panels forming a cabinet for housing the inner workings of the home appliance, each panel largely constructing one face of the cabinet. A door, operated by the user, provides access to the interior of the home appliance. For functional and aesthetic reasons, the door is installed flush with one face of the cabinet, to form at least a portion of the cabinet face, and is manually operated by a door handle fixed to an exterior surface of the door.

The door may be provided to any face of the cabinet and may be coupled to the door handle at one or more sites. Door handles having a long handle grip gripping surface are generally provided for operating large doors, i.e., doors occupying large areas of the cabinet face, in which case there are at least two coupling sites (handle bases). The door handle for such a door typically includes a handle grip as a bar separated from the door to allow the user's hand to grasp the door handle at a point along the bar between the coupling sites. A horizontally oriented bar is typically provided to a door opened by an upward or downward pulling action, and a vertically oriented bar is typically provided to a door opened by a pulling action that swings the door to the left or right.

Many appliances such as ovens, refrigerators, washers, dryers and dishwashers these days are provided with one or more prominent door handles typically fitted on the frontal face and arranged adjacent to the edge that typically lies opposite to that of the hinged edge. Thus, the handle is one of the few parts of the appliance that is extensively touched and felt by the user. The handle plays a key role in providing a satisfactory and enjoyable product experience to the user. Thus, there is a need to provide a door handle for an appliance which is easy to grip and enhances the enjoyment of using the appliance for the user.

A few problems are commonly associated with existing fixed door handles. For example, in most appliances, doors may need to be opened to nearly 180 degrees of an opening angle for providing a full and comfortable view and access to the internal cavity of the appliance. The fixed types of door handles in such cases would reach an awkward position when the doors are being opened beyond a 90 degree opening angle, making it difficult for the user to continue holding them while applying the door opening force. This may also require the user to stretch their arms/wrists extensively during wide-angle door opening or closing making such door operation uncomfortable and strenuous.

This deficiency in existing door handles may also prompt users to adopt a style of pulling hard and swinging the door to attempt a wide angle opening without having to retain handle contact during the entire door travel. This would result in doors being banged heavily against the structures and may result in damages to the door system and the structures. Further, this may also cause doors to retreat some travel after banging against the structure before finally coming to an undesired resting position.

Thus, there is a need to provide an articulated door handle for an appliance which overcomes the above-mentioned deficiencies and provides better and more advantageous overall results.

BRIEF DESCRIPTION OF THE INVENTION

The present disclosure relates to appliance door handles. More particularly, it relates to a device and method for causing an articulated motion of a door handle in response to the door operating force acting on the door thereby improving the door operation and making it ergonomically convenient to the user.

An appliance and door assembly is disclosed which has a body; a member extending from the body; at least one door mounted to the member; a handle mounted to said door; and a first linkage member connecting the handle to the member.

An articulated handle and door assembly has a door; a handle mounted to the door via a first hinged joint; and a linkage member connected to the handle via a second hinged joint.

A method of articulating a handle for an appliance door includes mounting a door to an appliance body via a hinged joint; mounting a handle to the door via a hinged joint; mounting a linkage member to the handle via a hinged joint and to the appliance body via a hinged joint; rotating the handle; and rotating the door in an opposite direction to the handle.

An articulated handle is provided in a direction opposite to the door opening direction thereby drastically reducing the stretching of the user's arms, and also maintaining handle contact throughout the wide angle door travel without extra stretching of the user's arms or wrists which results in a user-friendly feature that enhances user experience.

A structural member is integral to an appliance, a door is mounted onto the structural member, a door handle is mounted on the door of the appliance and at least one linkage interconnects the door handle to the structural member.

A door handle is mounted onto the door such that it may have a relative rotational motion or linear or curvilinear translational motion with respect to the door itself. The handle and the linkage are also configured such that the door opening or closing action causes the relative motion of the handle with respect to the door and the direction of this relative motion of the handle opposes the direction of relative motion of the door with respect to the structural member.

The door handle has a rotational motion with respect to the door, whereby the action of opening or closing of the door causes the handle to rotate relative to the same door.

When the door is turned in a clockwise direction with respect to the structural member, the handle is made to turn in a counter-clockwise direction with respect to the same door, as viewed from the same viewing direction.

Thus, one benefit of the present disclosure is to reduce efforts to move the handle as the door moves.

Another benefit is to reduce movement or stretching of the user's arms during operating of the door.

Yet another benefit of the disclosure is to reduce the possibility of the user touching a hot door liner when used in the application for an oven door.

Still other aspects and benefits of the disclosure will become apparent after a reading of the following detailed description.

BRIEF DESCRIPTION OF THE DRAWINGS

FIG. 16 illustrates a bottom hinged door and articulated handle assembly with a sliding door in accordance with another aspect of the disclosure;

FIG. 17 illustrates the bottom hinged door and handle assembly of FIG. 16 with the door in a slightly opened position;

FIG. 18 illustrates the bottom hinged door and handle assembly of FIG. 16 with the door in an opened position;

DETAILED DESCRIPTION OF THE INVENTION

The present disclosure relates to appliance door handles. More particularly, it relates to a device and method for causing an articulated motion of a door handle in response to the door operating force acting on the door thereby improving the door operation and making it ergonomically convenient to the user.

There may also be several variants wherein the door may be designed to be opened sideways (side hinged door) or from top (top hinged door) or from bottom (bottom hinged door). The articulating door handle may also be provided for a sliding door (sideways, upward or downward) wherein the sliding motion of the door may be used to impart relative motion to the door handle.

Figure 1:
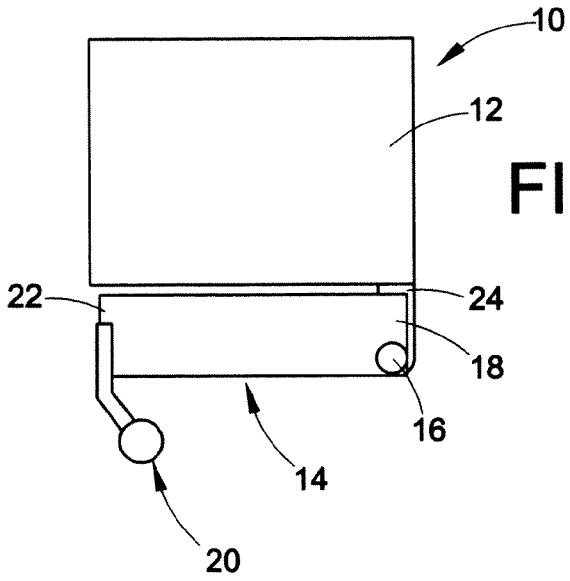
FIG. 1 illustrates of an appliance and side hinge door assembly with an articulated handle in accordance with one aspect of the disclosure.

Referring to FIG. 1, a side hinged door appliance 10 has a structural member or body 12, a door 14 connected to the body 12 by a conventional hinge 16 at a first end 18 of the door and a door handle 20 connected to the door at a second end 22 of the door. The door hinge 16 is connected to an arm or member 24 extending from the body at approximately 90 degrees. The appliance can be a refrigerator, oven or any appliance with a hinged door assembly. The door and the appliance body can be fabricated from metal, plastic or a combination thereof, as is well known in the art.

Figure 2:
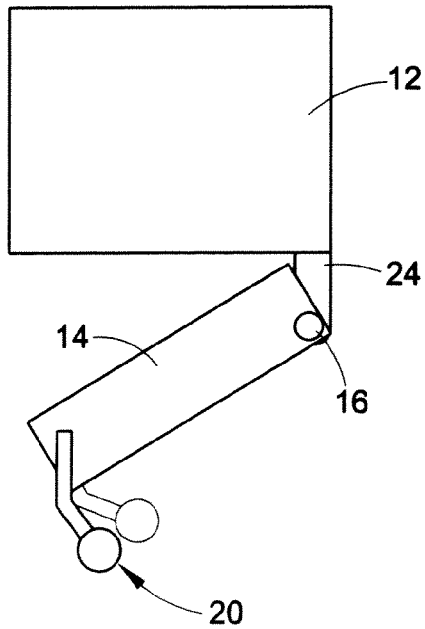
FIG. 2 illustrates of the appliance and door assembly with the door in a slightly opened configuration and the handle in a partially rotated position.
Figure 3:
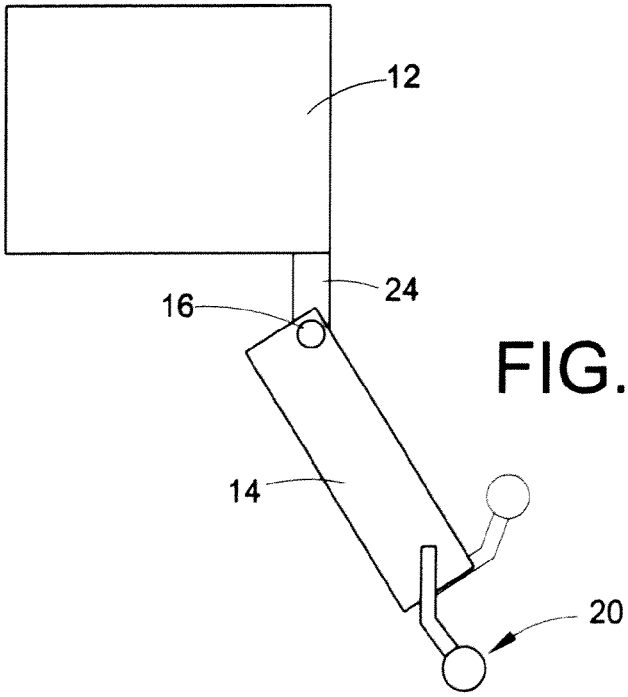
FIG. 3 illustrates of the appliance and door assembly of FIG. 1 with the door in an opened position and the handle in a fully articulated position.

The handle is articulated to move in an opposite direction to the door. That is, as seen in FIGS. 2 and 3, as the door 14 rotates counterclockwise, the user pulls on the handle 20 to rotate it clockwise in an opposite direction to the door.

Figure 4:
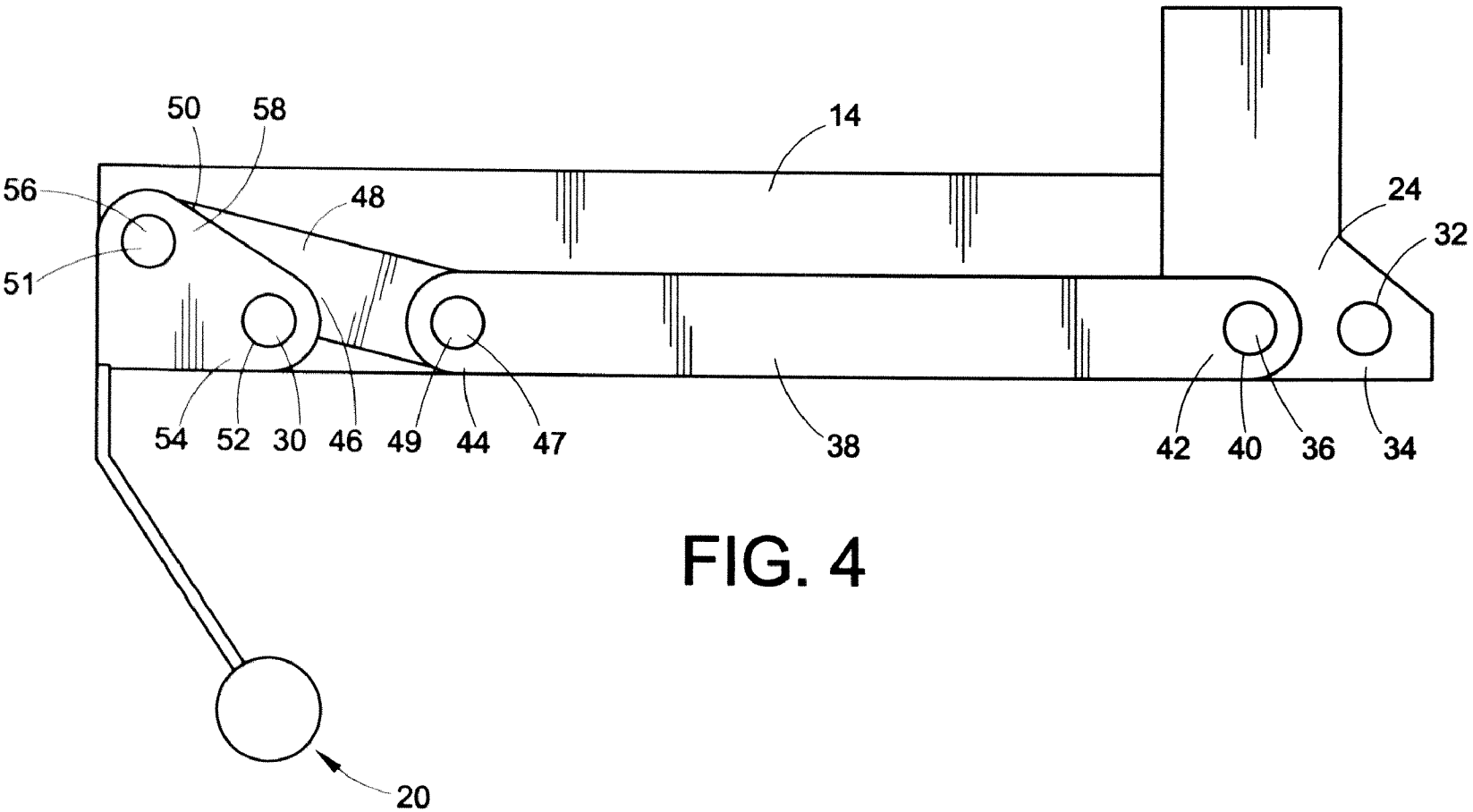
FIG. 4 illustrates a door and articulated handle with a linkage assembly in accordance with another aspect of the disclosure.
Figure 5:
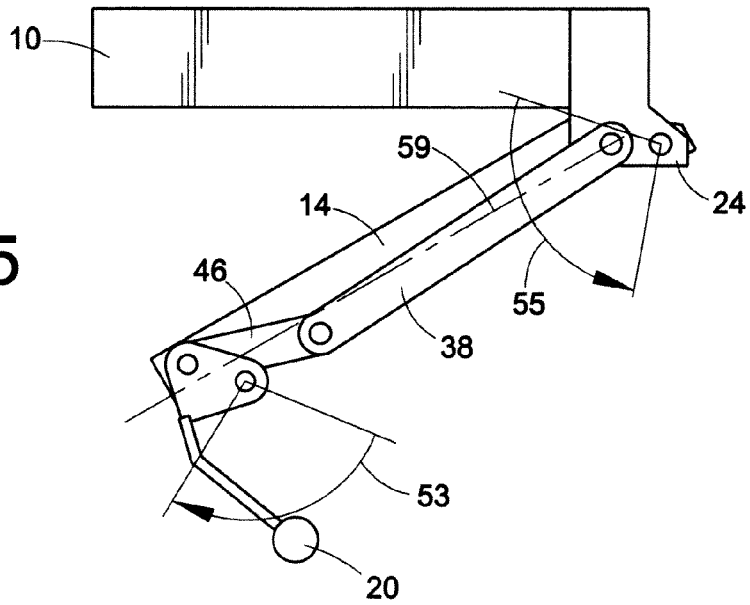
FIG. 5 illustrates the articulated handle and door assembly of FIG. 4 with the door and handle rotated slightly in opposite directions.
Figure 6:
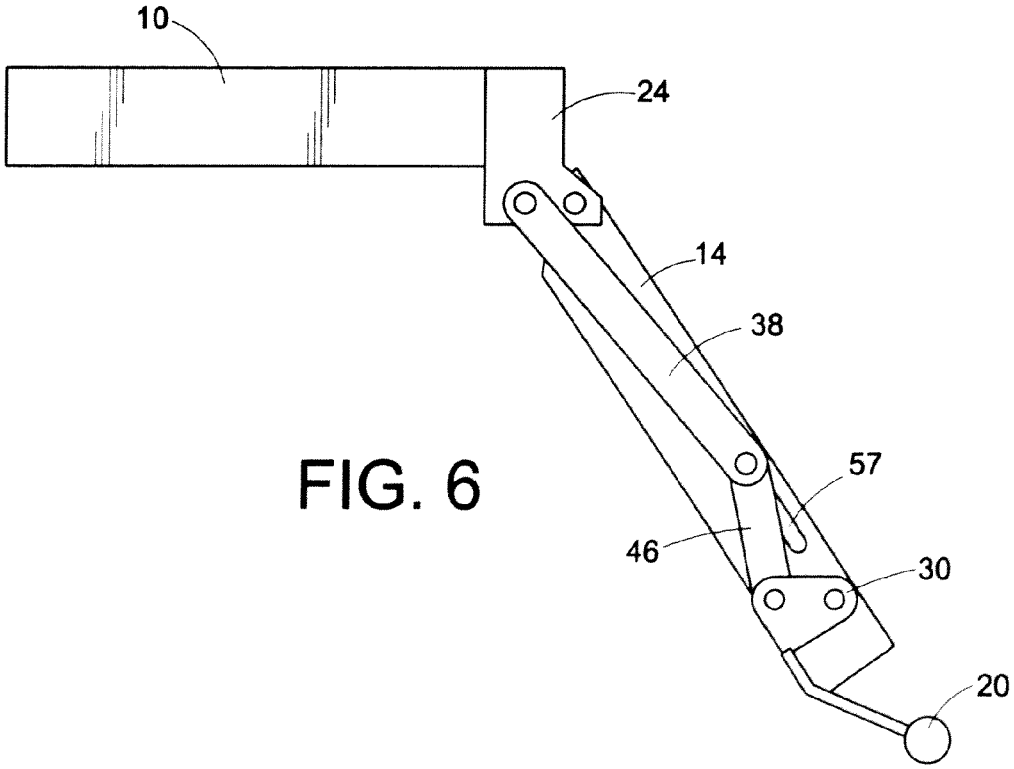
FIG. 6 illustrates the articulated handle and door assembly of FIG. 4 with the door and handle rotated in opposite directions.

Specifically, referring now to FIGS. 4-6, the door 14 has a first hinged joint 30 connected to the door handle 20 and a second hinged joint 32 connected to the arm 24 extending from the appliance body. The arm has a corresponding first hinged joint 34 with the door and a second hinged joint 36 with a linkage member or link 38 connected to the door handle. The link 38 is connected via a hinge 40 at a first end 42 of the link to the arm and at a second end 44 to a second link member or link 46 via a hinge 47. The second link 46 is attached at a first end 48 of the second link to the first link via hinge 49 and at a second end 50 to the door handle via hinge 51.

The door handle has a hinged joint 52 at a first end 54 of the handle connecting with the door and a hinged joint 56 at a second end 58 of the handle connecting with the second link 46.

Referring to FIGS. 5 and 6, the door handle 20 is pulled clockwise as shown by arrow 53 and the door 14 begins to travel in a counterclockwise manner with respect to the appliance body 12 as shown by arrow 55. The handle then travels in a clockwise manner relative to the door. The first link 38 moves upward along a longitudinal axis 59 of the door toward the arm 24 in a counterclockwise manner and the second link 46 rotates in a clockwise manner and also moves upwards toward the arm 24 along slot 57 in the door along longitudinal axis 59 of the door.

The door handle 20 also rotates clockwise and travels upwardly along the longitudinal axis of the door 14 as clearly shown in FIG. 6.

Figure 7:
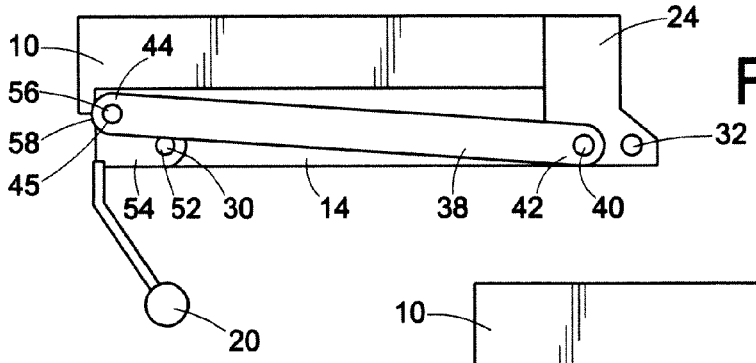
FIG. 7 illustrates an articulated handle and door assembly in accordance with another aspect of the disclosure.
Figure 8:
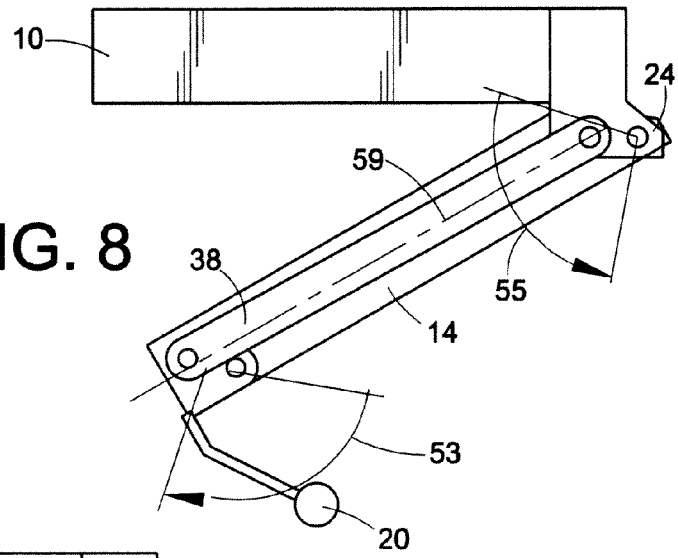
FIG. 8 illustrates the articulated door and handle assembly of FIG. 7 with the door and handle rotated slightly in opposite directions.
Figure 9:
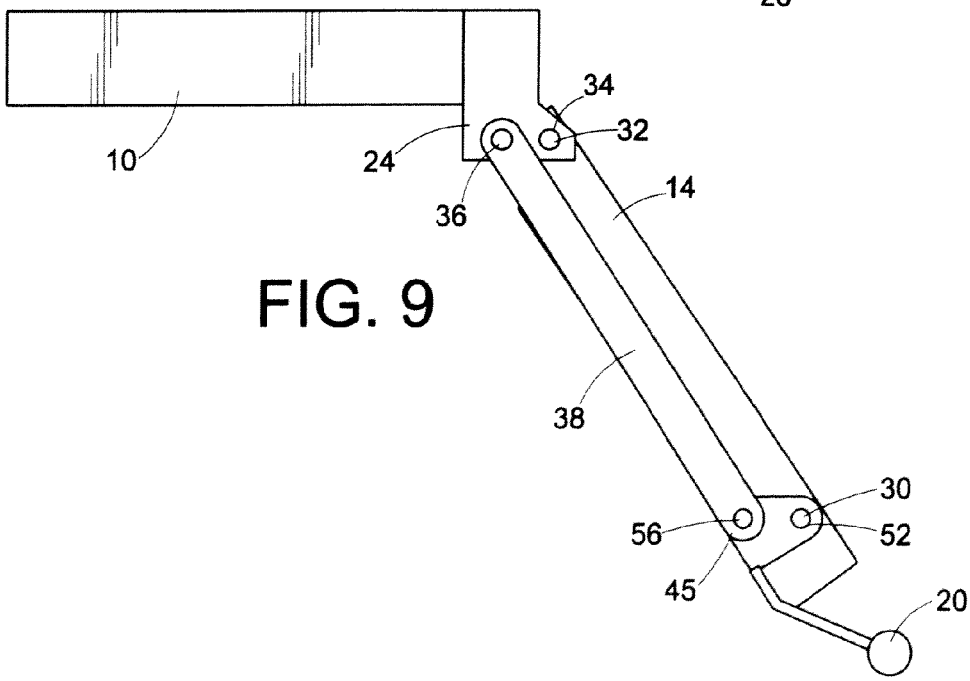
FIG. 9 illustrates the articulated door and handle assembly of FIG. 7 with the door and handle rotated in opposite directions.

Referring to FIGS. 7-9, the door 14 has a first hinged joint 30 connected to the door handle 20 and a second hinged joint 32 connected to arm 24 extending from the appliance body. The arm has a corresponding first hinged joint 34 with the door and a second hinged joint 36 with a link 38 interconnected to door handle 20. The link 38 is connected via a hinge 40 at a first end 42 of the link to the arm and at a second end 44 to the door handle via hinge 45.

The door handle has a hinged joint 52 at a first end 54 of the handle with the door and a hinged joint 56 at a second end 58 of the handle with the link 38.

Referring to FIGS. 8 and 9, the door handle 20 is pulled and rotates clockwise as shown by arrow 53 and the door 14 travels in a counterclockwise manner with respect to the appliance body 10 and arm 24 as shown by arrow 55. The handle then travels in a clockwise manner relative to the door via hinges 52 and 56. The link 38 rotates in a clockwise manner along longitudinal axis 59 of the door.

The door handle also rotates clockwise and travels upwardly along the longitudinal axis 59 of the door as shown in FIG. 9.

Figure 10:
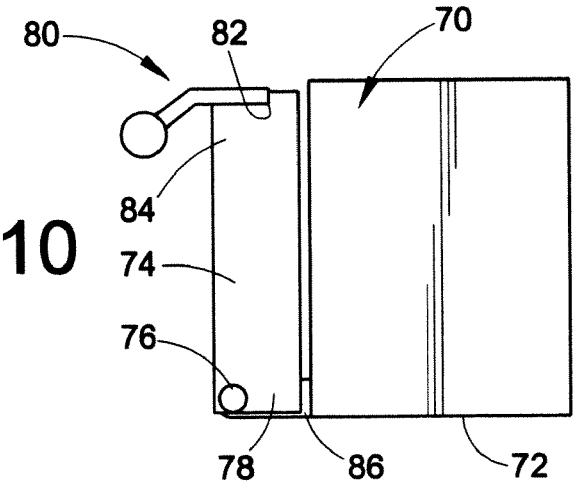
FIG. 10 illustrates a bottom hinged door and articulated handle assembly for an appliance in accordance with another aspect of the disclosure.
Figure 11:
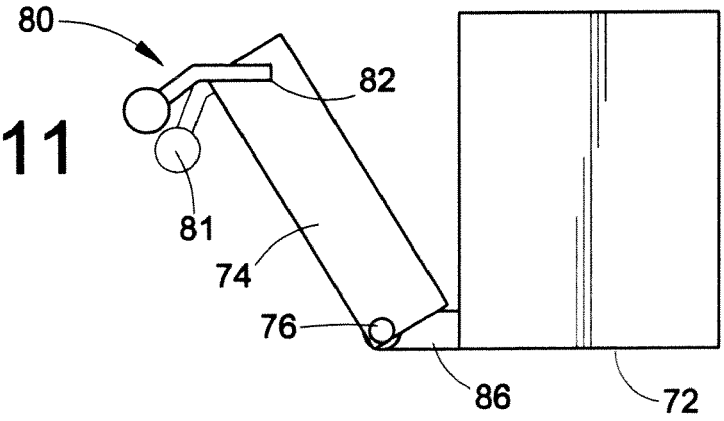
FIG. 11 illustrates the door and articulated handle assembly of FIG. 10 in a slightly opened configuration.
Figure 12:
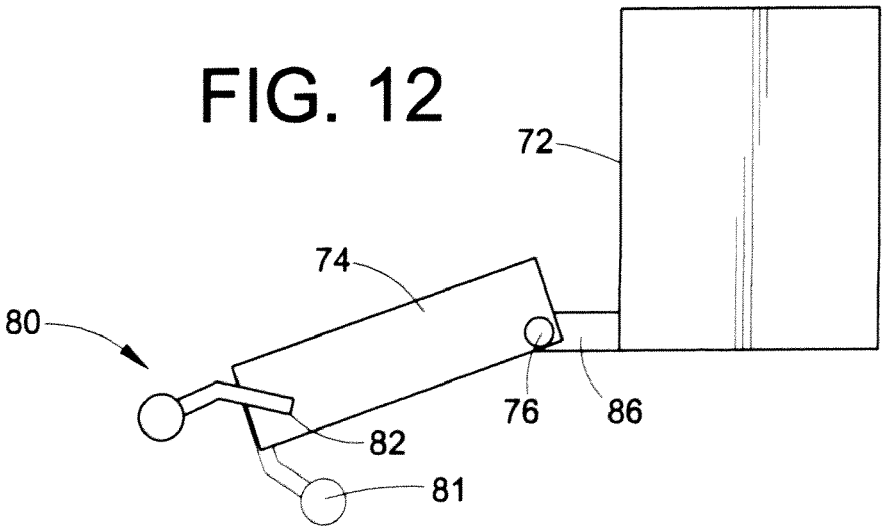
FIG. 12 illustrates the door and articulated handle assembly of FIG. 10 in a fully opened configuration.

Referring to FIGS. 10-12, a bottom hinged door appliance 70 has a structural member or body 72, a door 74 connected to the body 72 by a hinge 76, at a first end 78 of the door and a door handle 80 connected to the door by a door hinge 82 at a second end 84 of the door. The door hinge 76 is connected to an arm 86 extending from the body at approximately 90 degrees.

The handle is articulated to move in an opposite direction to the door. That is, as the door rotates counterclockwise, the user pulls on the handle to rotate it clockwise.

Specifically, referring to FIGS. 11 and 12, the door handle 80 is pulled downwardly and the door travels in a counterclockwise manner with respect to the appliance body 72. The handle is then pulled upwardly and travels in a clockwise manner relative to the door. The original position of the handle is shown as reference numeral 81.

Figure 13:
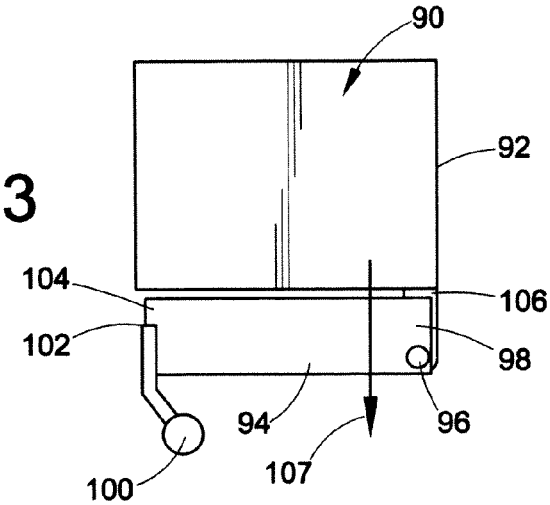
FIG. 13 illustrates a side hinged door and articulated handle assembly with a sliding door for an appliance in accordance with another aspect of the disclosure.
Figure 14:
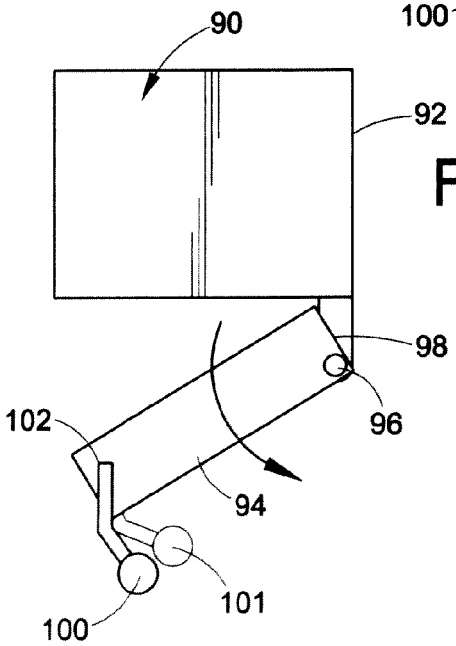
FIG. 14 illustrates the door and handle assembly of FIG. 13 in a slightly opened configuration.
Figure 15:
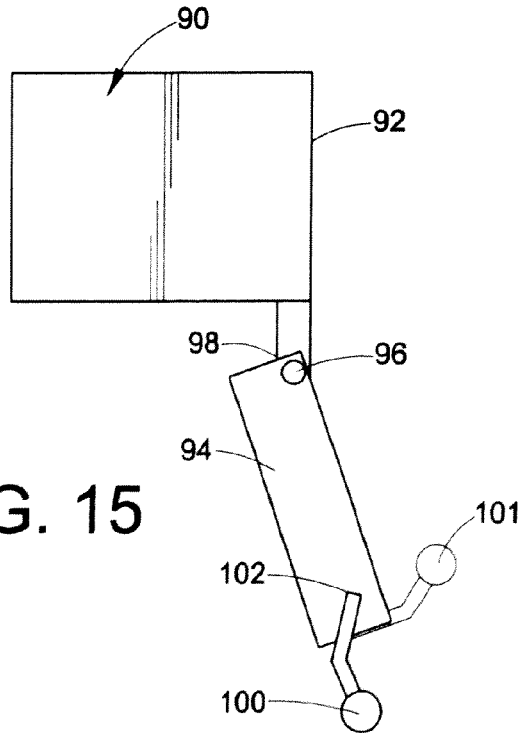
FIG. 15 illustrates the door and handle assembly of FIG. 13 in a fully opened configuration.

Referring to FIGS. 13-15, a side hinged door appliance 90 has a structural member or body 92, a door 94 connected to the body 92 by a hinge 96, at a first end 98 of the door and a door handle 100 connected to the door by a hinge 102 at a second end 104 of the door. The door hinge is connected to an arm 106 extending from the body at approximately 90 degrees.

The door is also configured to slide (in a vertical direction in FIGS. 13-15) along arrow 107 from the appliance body. The door slides away from the body on arm 106. Then the door is rotated counterclockwise with respect to the appliance body.

The handle is articulated to move in an opposite direction to the door. That is, as the door rotates counterclockwise, the user pulls on the handle to rotate it clockwise as seen in FIGS. 14 and 15. The original position of the handle is shown as reference numeral 101.

Referring to FIGS. 16-18, a bottom hinged door appliance 110 has a structural member or body 112, a door 114 connected to the body 112 by a conventional hinge 116, at a first end 118 of the door and a door handle 120 connected to the door by a hinge 122 at a second end 124 of the door. The door hinge is connected to an arm 126 extending from the body at approximately 90 degrees.

The door is also configured to slide (in a horizontal direction in FIGS. 16-18) away from the appliance body along arrow 115. Then the door is rotated counterclockwise with respect to the appliance body.

The handle is articulated to move in an opposite direction to the door. That is, as the door rotates counterclockwise, the user pulls up on the handle 120 to rotate it clockwise. The original position of the handle is shown as reference numeral 125.

Figure 19:
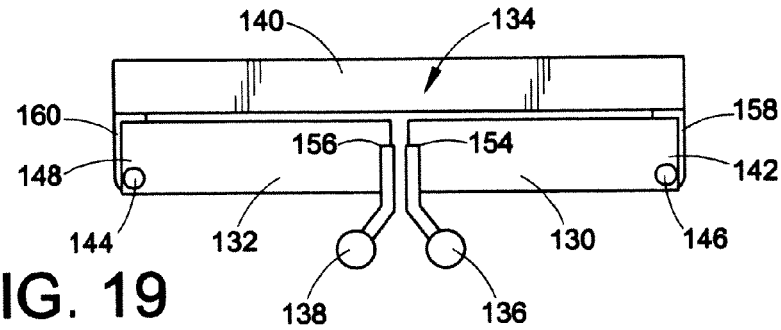
FIG. 19 illustrates a double door and articulated handle assembly for an appliance in accordance with another aspect of the disclosure.
Figure 20:
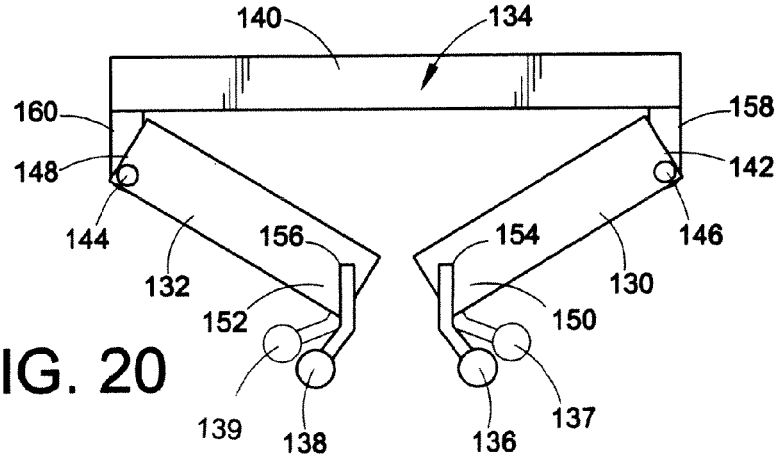
FIG. 20 illustrates the double door and handle assembly of FIG. 19 with the doors in a slightly opened configuration.
Figure 21:
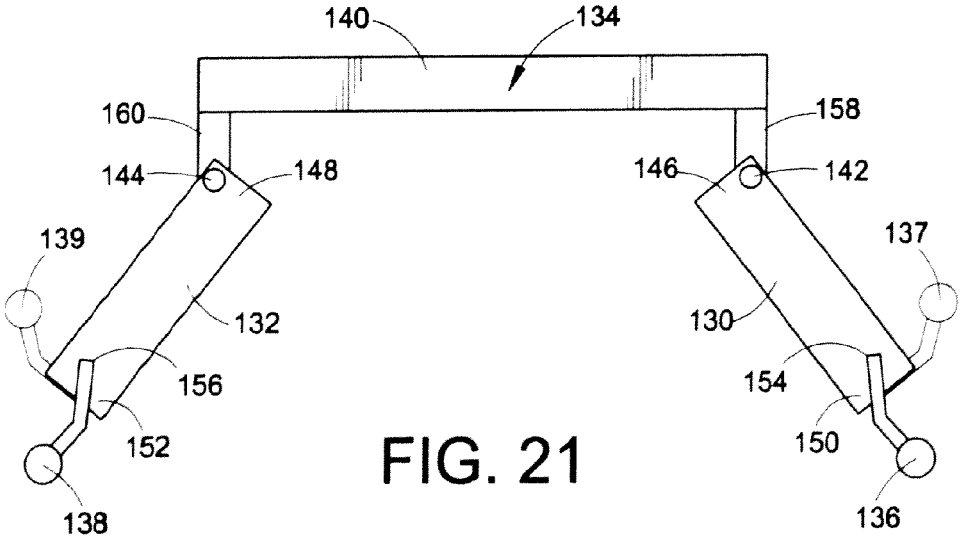
FIG. 21 illustrates the door and handle assembly of FIG. 19 with the doors in an opened configuration.

Referring to FIGS. 19-21, a plurality of doors 130, 132 may be also provided to a double rotating door appliance 134 wherein each door has its own articulating handle 136, 138. Referring to FIG. 19, appliance 134 has a structural member or body 140, doors 130, 132 connected to the body by conventional hinges 142, 144, at first ends 146, 148 of the doors and door handles 136, 138 are connected to the door at second ends 150, 152 of the door via hinges 154, 156. Each door hinge is connected to an arm 158, 160 extending from the body at approximately 90 degrees on opposite ends of the body. Each handle is articulated to move in an opposite direction to the corresponding door. That is, as door 130 rotates counterclockwise, the user pulls on the handle 136 to rotate it clockwise about hinge 154. Similarly, as door 132 is rotated clockwise, the handle 138 is rotated counterclockwise about hinge 156. The original positions of the handles are shown as reference numerals 137, 139, respectively.

Figure 22:
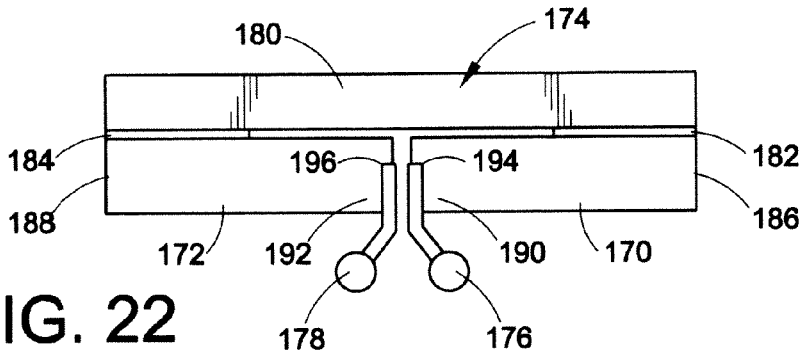
FIG. 22 illustrates a double door and articulated handle assembly for an appliance with sliding doors in accordance with another aspect of the disclosure.
Figure 23:
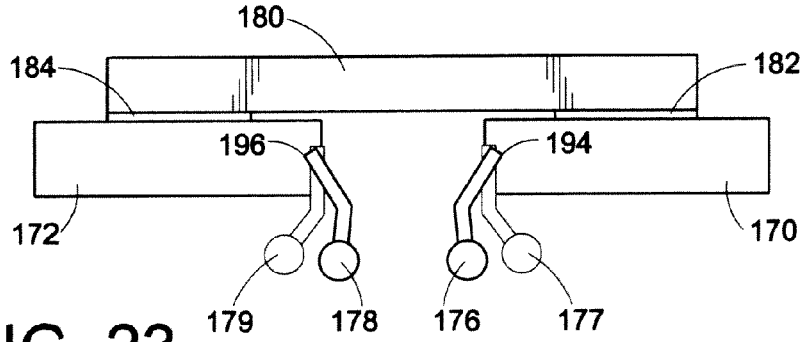
FIG. 23 illustrates the double door and handle assembly of FIG. 22 with the doors slightly slid and the handles slightly rotated.
Figure 24:
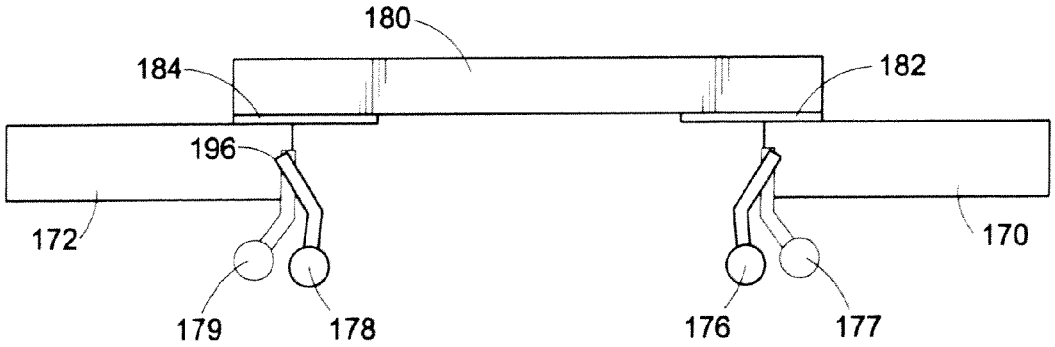
FIG. 24 illustrates the double door and handle assembly of FIG. 22 with the doors slid and the handles rotated.

Referring to FIGS. 22-24, a plurality of sliding doors 170, 172 may be also provided to a double rotating door appliance 174 wherein each door has its own articulating handle 176, 178. Referring to FIG. 22, appliance 174 has a structural member or body 180, doors 170, 172 connected to the body by sliding mechanisms 182, 184 (such as a conventional track or a slot, as is well known in the art) at first ends 186, 188 of the doors and door handles 176, 178 are connected to the door at second ends 190, 192 of the door via conventional hinges 194, 196. Each handle is articulated to move as the corresponding door is slid or moved. That is, as door 170 is slid to the right (in FIGS. 23 and 24), the user pulls on the handle 176 to rotate it clockwise. The original position of the handle is shown as reference numeral 177. Similarly, as door 172 is slid to the left (in FIGS. 23 and 24), the handle 178 is rotated counterclockwise. The original position of the handle is shown as reference numeral 179.

Figure 25:
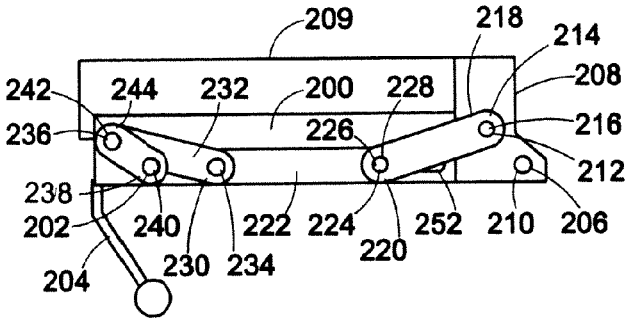
FIG. 25 illustrates a door and articulated handle with a linkage assembly in accordance with another aspect of the disclosure.
Figure 26:
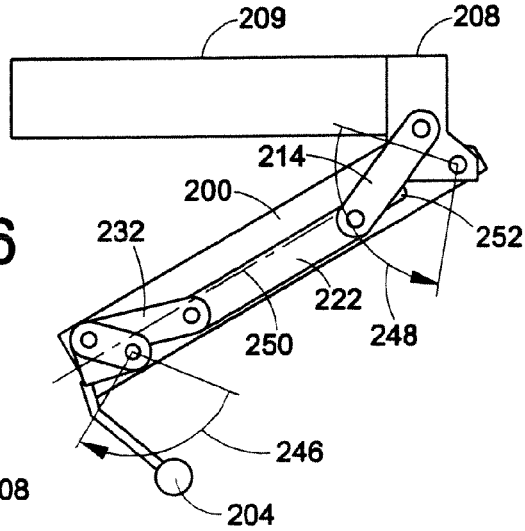
FIG. 26 illustrates the articulated handle and door assembly of FIG. 25 with the door and handle rotated slightly in opposite directions.
Figure 27:
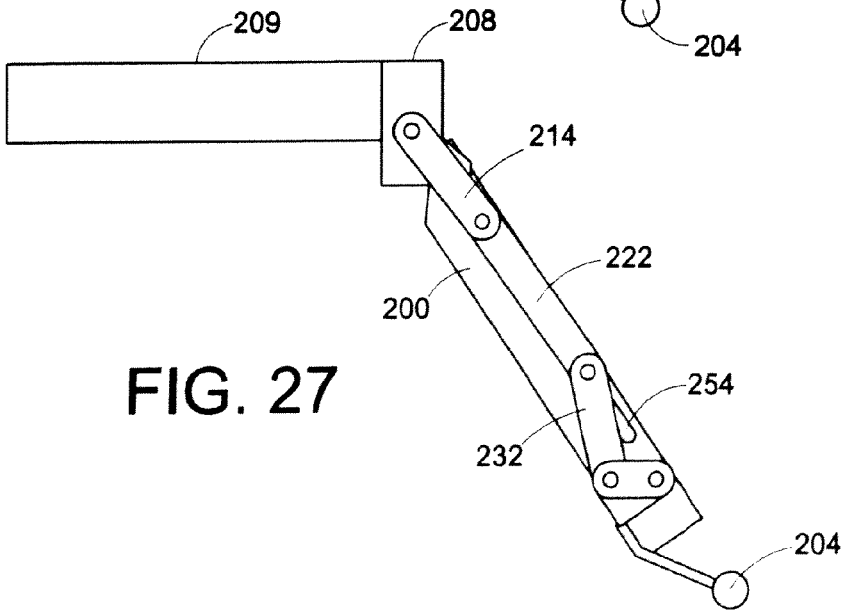
FIG. 27 illustrates the articulated handle and door assembly of FIG. 25 with the door and handle rotated in opposite directions.

Referring now to FIGS. 25-27, a door 200 has a first hinged joint 202 connected to door handle 204 and a second hinged joint 206 connected to arm 208 extending from appliance body 209. The arm has a corresponding first hinged joint 210 with the door and a second hinged joint 212 with a first linkage member or link 214 connected to the door handle. The link 214 is connected via a hinge 216 at a first end 218 of the link to the arm and at a second end 220 to a second link member or link 222 via a hinge 224. The second link is attached at a first end 226 of the second link to the first link via hinge 228 and at a second end 230 to a third link 232. The third link 232 is connected via a hinge 236 to the door handle.

The door handle has a hinged joint 238 at a first end 240 of the handle connecting with the door and a hinged joint at a second end 244 of the handle connecting with the third link.

Referring to FIGS. 26 and 27, the door handle is pulled clockwise as shown by arrow 246 and the door begins to travel in a counterclockwise manner with respect to the appliance body as shown by arrow 248. The handle then travels in a clockwise manner relative to the door. The first link moves upward along a longitudinal axis 250 of the door toward the arm in a counterclockwise manner along elongated slot 252 in the door along the longitudinal axis of the door. Third link 232 moves upwardly along a second elongated slot 254 in a clockwise manner along longitudinal axis 250 of the door.

The door handle also rotates clockwise and travels upwardly along the longitudinal axis of the door as clearly shown in FIG. 27.

The appliance door system can have both translational and rotational motion of the door in succession to span the total length and time of door travel, and one or either of these respective motions may be used to articulate the door handle during the respective lengths of door travel. This feature enables usage of articulated handle on complex door systems where the doors themselves have an articulated motion with respect to the appliance structure.

Figure 28:
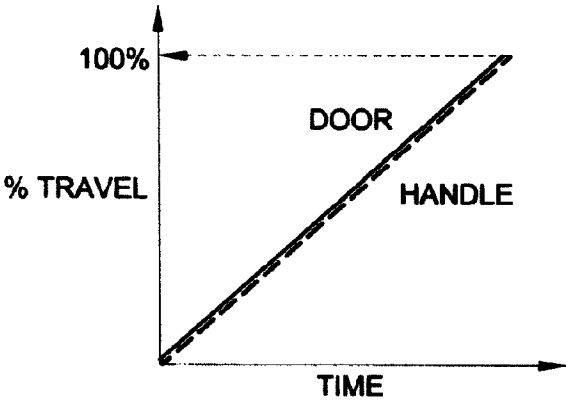
FIG. 28 illustrates a graph showing door and handle travel where the door and handle travel the same amount over a period of time.
Figure 29:
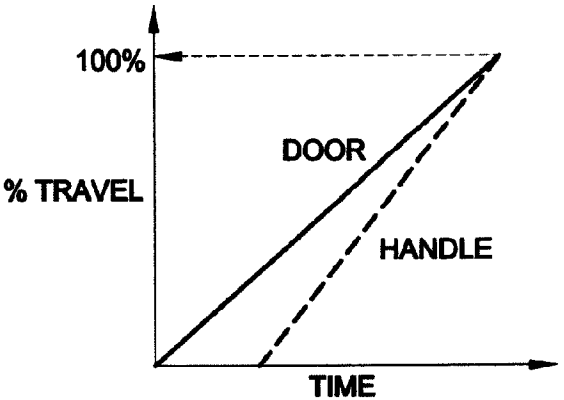
FIG. 29 illustrates a graph showing door and handle travel where the handle lags the door over time.
Figure 30:
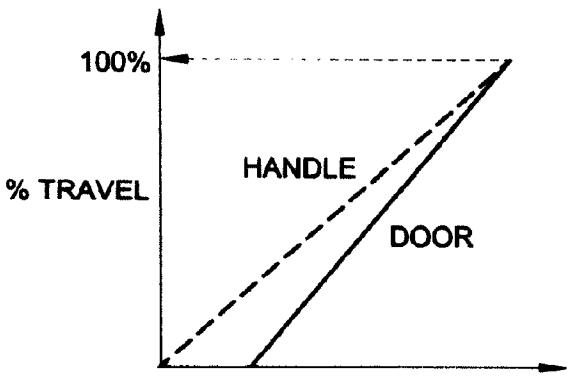
FIG. 30 illustrates a graph showing door and handle travel where the door lags the handle over time.
Figure 31:
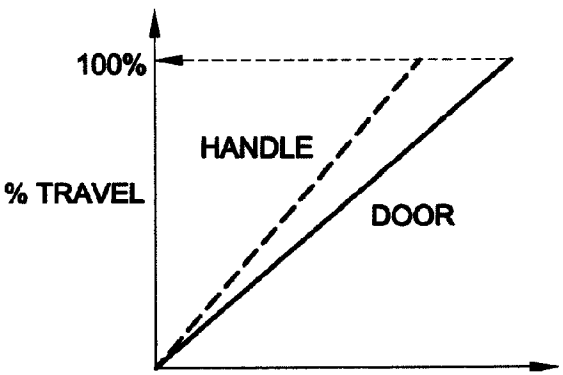
FIG. 31 illustrates a graph showing door and handle travel where the door and handle initially travel at the same rate over time then handle stops traveling and the door continues to travel.

Referring to the charts in FIGS. 28-45, the door and handle can provide that the length and time of travel of the door with respect to the structural member is not equal to that of the door handle with respect to the same door. In FIG. 28, the door and handle travel the same length over the same time period. In FIG. 29, the door and handle do not have an equal length and time of travel, in which a dwell period for which the door handle may not have a relative motion with respect to the door occurs. Referring to FIG. 30, there can be provided handle articulation with the help of user applied force during initial time when the door does not move and the articulation continues when the door is in motion. As seen in FIG. 31, both the door and handle move in synchronization during part of the length and time of door travel followed by a constrained door handle for the rest of the door travel.

Figure 32:
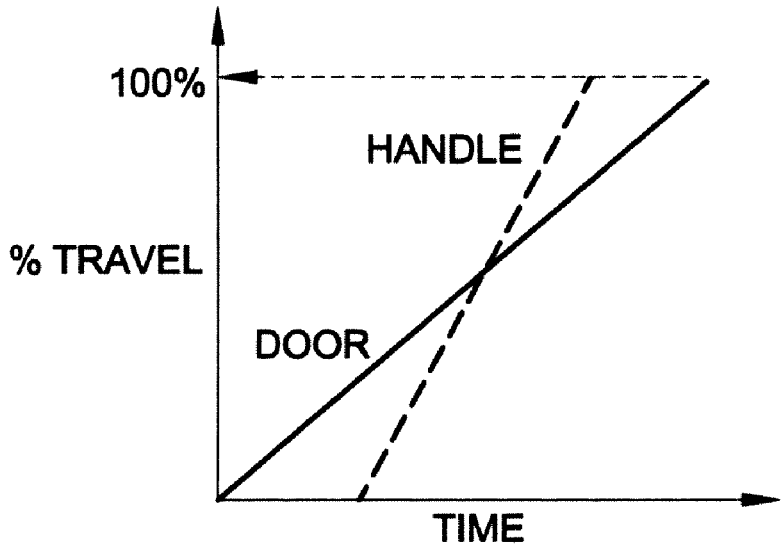
FIG. 32 illustrates a graph showing door and handle travel where the door travels ahead of the handle and the handle completes travel before the door.
Figure 33:
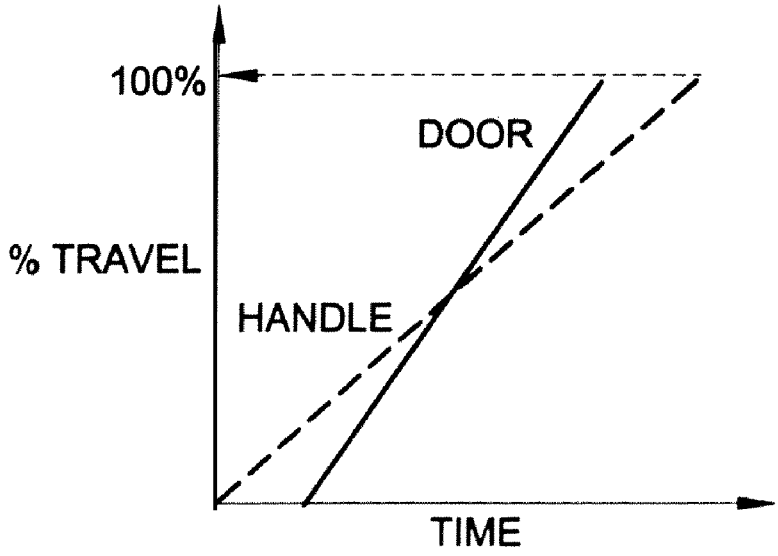
FIG. 33 illustrates a graph showing door and handle travel where the handle travels ahead of the door and the door completes travel before the handle.
Figure 34:
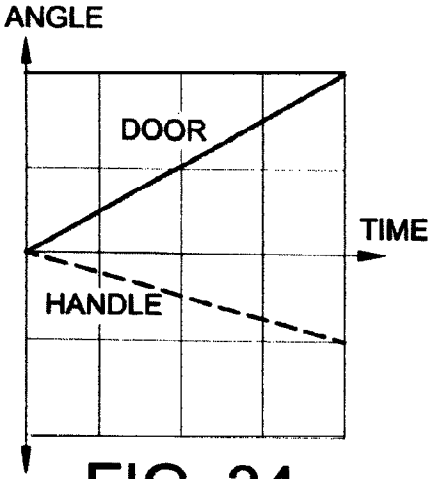
FIG. 34 illustrates a graph showing the door and handle angular travel over the same period of time.
Figure 35:
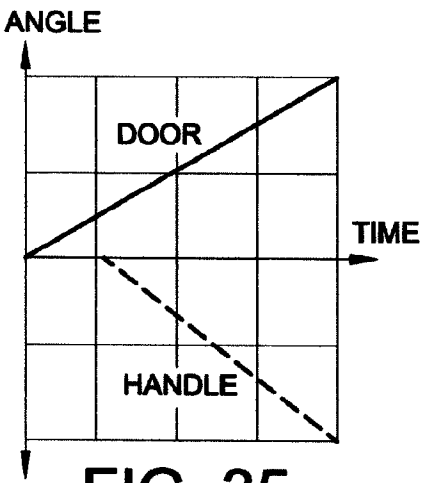
FIG. 35 illustrates a graph showing the door angular travel beginning before the handle angular travel over a period of time.

As seen in FIG. 32, the door and handle travel wherein the door begins travel before the handle and the handle completes travel before the door. The door continues to complete its range of travel. FIG. 33 shows door and handle travel where the handle begins travel before the door and the door completes travel before the handle. The handle then continues its range of motion. FIG. 34 shows the door and handle angular travel over the same period of time. FIG. 35 shows the door angular travel beginning before the handle angular travel over a period of time. There is a dwell or lag period before the handle begins to rotate. The angular velocity of the handle relative to the door and the angular velocity of the door relative to the arm extending from the appliance body may vary at different rates for at least part of the maximum door rotation angle. A dwell period can exist for rotation of the handle or rotation of the door relative to each other. The dwell period coincides with either the fully open or fully closed position of the door.

Figure 36:
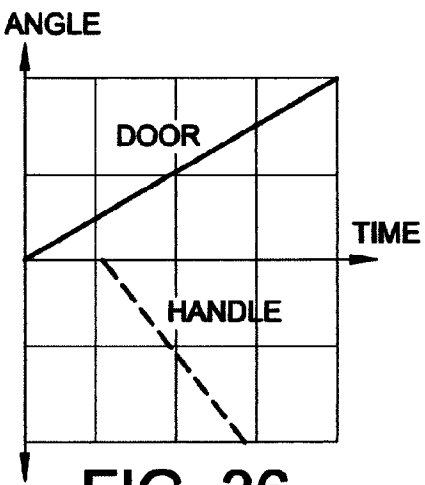
FIG. 36 illustrates a graph showing the door angular travel beginning before the handle and continuing after the handle's travel.
Figure 37:
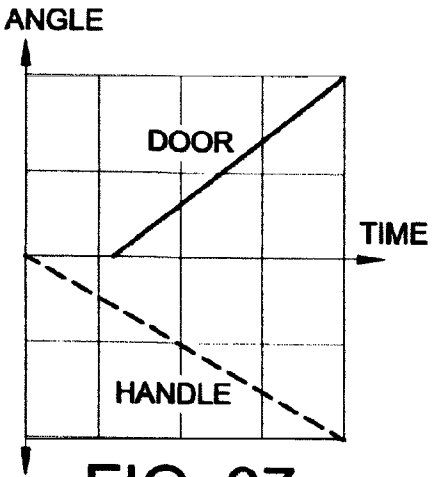
FIG. 37 illustrates a graph showing the handle angular travel before the door angular travel.
Figure 38:
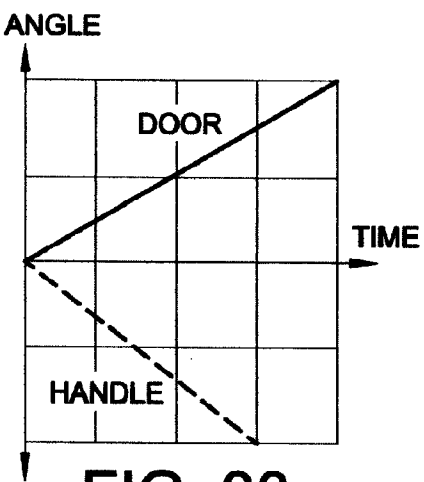
FIG. 38 illustrates a graph showing the door and handle angular travel where the handle completes travel and the door continues to travel.
Figure 39:
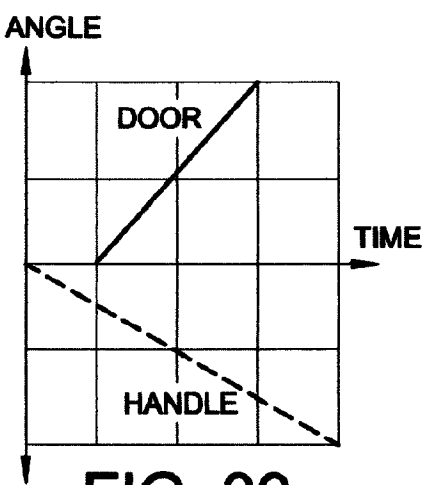
FIG. 39 illustrates a graph showing handle angular travel before door angular travel.

FIG. 36 shows the door angular travel beginning before the handle and continuing after the handle's travel. FIG. 37 shows a graph showing the handle angular travel before the door angular travel. There is a dwell or lag period before the door begins to rotate. FIG. 38 shows a graph showing the door and handle angular travel where the handle completes travel and the door continues to travel. FIG. 39 shows handle angular travel before door angular travel and the door completes travel while the handle continues to move.

Figure 40:
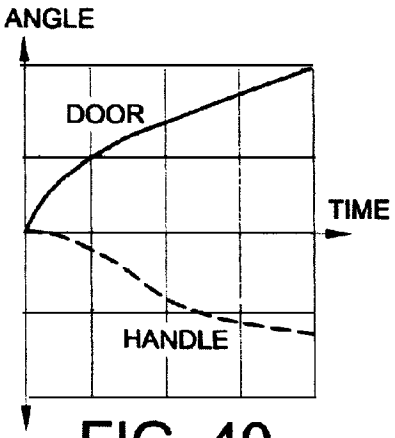
FIG. 40 illustrates a graph showing nonlinear angular movement of the door and handle over time.
Figure 41:
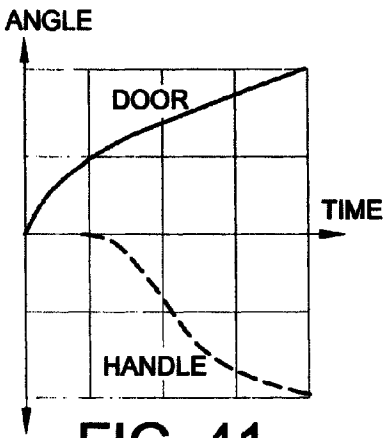
FIG. 41 illustrates a graph showing nonlinear angular movement of the door before the handle over time.
Figure 42:
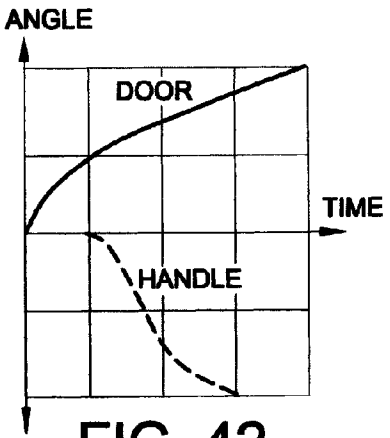
FIG. 42 illustrates a graph showing nonlinear angular movement of the door and handle where the handle moves after the door and stops moving before the door.
Figure 43:
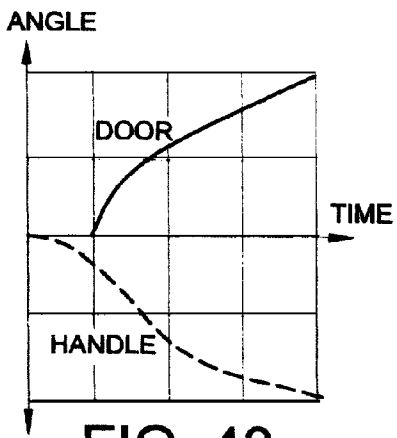
FIG. 43 illustrates a graph showing nonlinear angular movement of the handle before the door over time.
Figure 44:
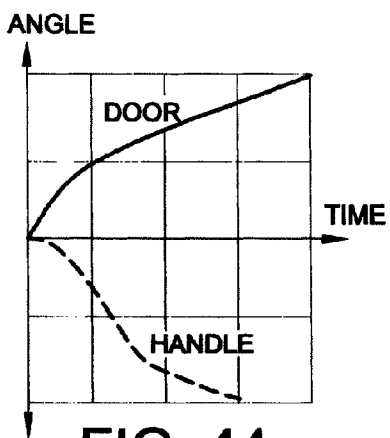
FIG. 44 illustrates nonlinear angular movement of the door and handle where the handle stops moving before the door.
Figure 45:
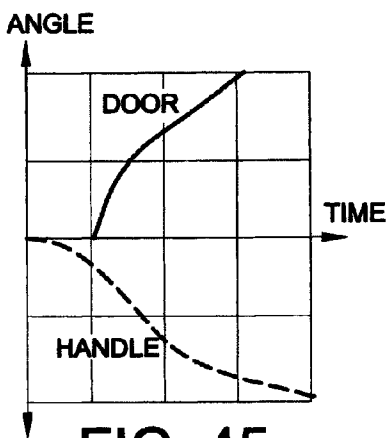
FIG. 45 illustrates nonlinear angular movement of the door and handle where the door starts moving after the handle and stops moving before the handle.

FIG. 40 shows nonlinear angular movement of the door and handle over the same period of time. FIG. 41 shows nonlinear angular movement of the door before the handle over time. There is a dwell or lag period before the handle begins to rotate. FIG. 42 shows nonlinear angular movement of the door and handle where the handle moves after the door and stops moving before the door. FIG. 43 shows nonlinear angular movement of the handle before the door over time. There is a dwell or lag period before the door begins movement. FIG. 44 shows nonlinear angular movement of the door and handle where the handle stops moving before the door. FIG. 45 illustrates nonlinear angular movement of the door and handle where the door starts moving after the handle and stops moving before the handle.

Unlike the alternatives discussed above, wherein the user applied force for door operation is utilized to cause the door handle to move in an articulated way, an external energy source such as a motor or actuator augments or substitutes the human force to accomplish the articulated movement of the door handle. Specifically, a displacement sensor may be deployed to continuously monitor door travel and the response of this sensor is used to govern the operation of any motor or actuator that facilitates the articulated movement of door handle.

The articulating door handle assembly described above may be incorporated into French door ovens, such as single well ovens, double well ovens, microwave ovens, and ovens with a full glass front, panel, colored solid panels, and stainless steel door trims. The articulated door handle may also be used with freestanding, slide and drop-in ranges, as well as dishwashers, ice dispensers, refrigerators, washers and dryers.

The articulated door and handle assembly uses the door operating force/motion to articulate the handle dynamically in synchronization with door opening thereby maintaining a comfortable handle orientation throughout the length and time of door travel for the user and also reduces the extent of stretching of arm the user may have to do in order to operate the door.

The present disclosure has been described with reference to the preferred embodiments. Obviously, modifications and alterations will occur to others upon reading and understanding the preceding detailed description. It is intended that the disclosure be construed as including all such modifications and alterations.

What is claimed is:

1. An appliance and door assembly, comprising:

a body;

a member extending from the body;

at least one door mounted to said member;

a handle mounted to said door; and a first linkage member connecting said handle to said member; wherein said member comprises a hinged joint between said member and said first linkage member;

a second linkage member connecting said first linkage member to said handle; and wherein said door comprises an elongated slot wherein said first and second linkage members slide along said slot.

2. The appliance and door assembly of claim 1, wherein said member comprises an arm which extends at substantially 90 degrees from said body.

3. The appliance and door assembly of claim 1, wherein said handle further comprises a hinged joint between said handle and said door.

4. The appliance and door assembly of claim 1, wherein said handle further comprises a hinged joint between said handle and said second linkage member.

5. The appliance and door assembly of claim 1, wherein said member comprises a hinged joint between said member and said door.

6. The appliance and door assembly of claim 1, wherein said handle is mounted to said door so that said handle rotates relative to said door.

7. The appliance and door assembly of claim 6, wherein when said door is opened and closed, said handle rotates relative to said door.

8. The appliance and door assembly of claim 1, wherein when said door is turned in a clockwise direction relative to said member, said handle turns in a counterclockwise direction relative to said door.

9. The appliance and door assembly of claim 8, wherein angular velocity of said handle relative to said door and angular velocity of said door relative to said member vary at different rates at least for a part of the maximum door rotation angle.

10. The appliance and door assembly of claim 8, wherein a dwell period exists for rotation of said handle or rotation of said door relative to each other.

11. The appliance and door assembly of claim 10, wherein a beginning of said dwell period coincides either with fully open or fully closed position of said door.

12. The appliance and door assembly of claim 1, further comprising a second member extending from said body and a second door mounted to said second member.

13. The appliance and door assembly of claim 12, wherein said second door comprises a second handle and a third linkage member which connects said second handle to said second member.

14. The appliance and door assembly of claim 12, wherein said second member comprises an arm which extends at substantially 90 degrees from said body.

15. The appliance and door assembly of claim 14, further comprising a fourth linkage member connecting said third linkage member to said second handle.

16. The appliance and door assembly of claim 12, wherein said second handle is mounted to said second door so that said second handle rotates relative to said second door.

17. A method of articulating a handle for an appliance door, comprising:

mounting a door to a member of an appliance body via a first hinged joint;

mounting a handle to said door via a second hinged joint;

mounting a first linkage member to said member of said appliance body via a third hinged joint;

mounting a second linkage member to said handle via a fourth hinged joint and to said first linkage member via a fifth hinged joint;

rotating said handle about said second hinged joint;

rotating said door in an opposite direction to said handle about said first hinged joint; and, wherein said first linkage member and said second linkage member slide within an elongated slot within said door.

18. The method of claim 17, wherein said handle is rotated at the same time as when said door is rotated.

19. The method of claim 17, wherein said handle and said door are rotated in opposite directions to each other.

20. The method of claim 17, wherein angular velocity of said handle relative to said door and angular velocity of said door relative to said appliance body are varied at different rates at least for a part of the maximum door rotation angle.

21. The method of claim 17, wherein a dwell period is introduced for rotation of said handle or rotation of said door relative to each other.

22. The method of claim 21, wherein a beginning of said dwell period is coincided either with fully open or fully closed position of said door.

* * * * *